United States Patent [19]

Peterson

[11] Patent Number: 4,622,887

[45] Date of Patent: Nov. 18, 1986

[54] VENTILATION APPARATUS AND METHODS OF MAKING AND USING SAME

[75] Inventor: James R. Peterson, Westland, Mich.

[73] Assignee: Jimco Products, Inc., Livonia, Mich.

[21] Appl. No.: 793,454

[22] Filed: Oct. 28, 1985

Related U.S. Application Data

[63] Continuation of Ser. No. 176,608, Aug. 8, 1980, abandoned, which is a continuation of Ser. No. 638,030, Dec. 5, 1975, abandoned.

[51] Int. Cl.[4] ..... F23L 17/02

[52] U.S. Cl. ..... 98/66.1; 98/42.01; 52/198; 285/382.2

[58] Field of Search ..... 98/66 R, 122, 66 A, 98/75, 42 R, 42 A, 82–84, 66.1, 42.01; 52/198, 199; 285/382.2

[56] References Cited

U.S. PATENT DOCUMENTS

| | | | |
|---|---|---|---|
| 470,514 | 3/1892 | Simpson | 285/382.2 |
| 487,434 | 12/1892 | Steen | 285/382.2 |
| 1,703,037 | 2/1929 | Heck | 285/382.2 |
| 1,998,653 | 4/1935 | Briegel | 285/382.2 |
| 2,233,471 | 3/1941 | Clements | 285/382.2 |
| 2,277,982 | 3/1942 | Hosbein | 98/42 R |
| 2,625,094 | 1/1953 | Bonforte | 98/42 R |
| 2,981,787 | 4/1961 | Brautigam et al. | 285/382.2 |
| 3,238,862 | 3/1966 | Smith et al. | 98/82 |
| 3,421,429 | 1/1969 | Stone | 98/82 |
| 3,475,885 | 11/1969 | Kline | 98/42 R |
| 3,593,478 | 7/1971 | Mason | 52/302 |
| 3,599,378 | 8/1971 | Kachnic | 52/198 |
| 3,783,767 | 1/1974 | Stalker | 98/42 R |
| 4,226,449 | 10/1980 | Cole | 285/382.2 |

FOREIGN PATENT DOCUMENTS

| | | | |
|---|---|---|---|
| 411969 | 6/1934 | United Kingdom | 98/66 A |
| 970733 | 9/1964 | United Kingdom | 98/82 |

*Primary Examiner*—Henry C. Yuen

*Attorney, Agent, or Firm*—Cullen, Sloman, Cantor, Grauer, Scott, & Rutherford

[57] ABSTRACT

A unitary, metal vent apparatus for securement to the roof of a building. The apparatus includes a one-piece hollow first member having a series of vent holes near its top portion. The apparatus also includes a one-piece second member which forms a concentric cap for the first member and which protects the upper portion of the first member from the elements, but does not impair or contact the vent holes. Preferably, the cap is spun onto the first member for rigid securement thereto.

2 Claims, 5 Drawing Figures

VENTILATION APPARATUS AND METHODS OF MAKING AND USING SAME

This application if a continuation of U.S. patent application Ser. No. 176,608, filed Aug. 8, 1980, now abandoned which is a continuation of U.S. patent application Ser. No. 638 030, filed Dec. 5, 1975, now abandoned.

The present invention relates generally to a novel ventilation apparatus and methods of fabricating and utilizing same. In particular, the present invention relates to a metal ventilation apparatus which is especially suitable for use in conjunction with the roofs of various buildings.

BACKGROUND OF THE INVENTION

Heretofore, there has been in use metal ventilation apparatus which may be secured to roofs for various ventilation purposes. It is well known that if a building is warm inside and cold outside, and there is sufficient humidity within the building, this humidity will condense on contact with the cold surface of the building. This is usually most noticable at the roof. All this condensed humidity or moisture will eventually cause the wood and other room material to rot, thus necessitating steps to be taken to prevent such condensation from occurring. This is achieved by ventilating adequately all parts of the building where condensation is likely to occur.

In the roof, even when a vapor barrier has been used, condensation may still occur, so that all parts of the roof behind the insulation should be thoroughly ventilated. This can be achieved in part by providing for an air flow between the rafters, and under the sheathing and behind the insulation.

Apart from the condensation problem mentioned hereinabove, there exists of course the basic ventilation problem of supplying fresh air to indoor places and at the same time removing stale air from these places. For people to feel comfortable, they need fresh air which is free from dust, soot and odors. In addition, the air must not be too warm or too cool, and it must have the right amount of moisture.

The more people there are in a room, or the harder they work, the faster the air becomes stale. Stale air must be removed and replaced with fresh air. If the air outside is fresh, simply opening a window and perhaps turning on a fan will ventilate the room. This of course is not possible if the room is on the inside of a building, or if the space or room to be ventilated is an attic or a crawl space.

The amount of air required for proper ventilation varies, depending on the room and the number of people in it. Under ordinary conditions, from 10 to 30 cubic feet (0.3 to 0.8 cubic meters) of fresh air must be supplied each minute for each person in the room.

The ventilation apparatus of the known type mentioned hereinabove is also helpful in removing harmful materials from the air. In addition to its use in connection with commercial buildings, it may also find use in mines or tunnels, and factories. In places such as mines or tunnels, poisonous gases may be present which must be removed before men can safely work there. In addition, factories may use such ventilation apparatuses to remove harmful fumes resulting from industrial processes.

One of the disadvantages of the conventional vent apparatus, which is depicted in FIGS. 4 and 5 of the accompanying drawings, is that it requires three separate and distinct members or pieces which are relatively expensive to manufacture and which necessitate a relatively complicated process to construct together to form the desired vent apparatus. Moreover, such conventional vent apparatus is not sturdy, has limited duration of use, is susceptible of deterioration when exposed to the elements, and requires somewhat complicated lip forming and interconnection procedures.

The problems and disadvantages alluded to hereinabove with respect to the conventional roof ventilation apparatus are either eliminated or greatly alleviated by the present invention.

BRIEF SUMMARY OF THE INVENTION

The present invention provides a ventilation apparatus comprising, in combination, a one-piece first member which is provided with a substantially vertical hollow portion and a substantially horizontal, substantially flat, annular portion. The substantially vertical hollow portion of the one-piece first member is provided with at least one ventilation aperture therethrough in a predetermined portion thereof. The ventilation apparatus also includes a one-piece second member which is provided with a substantially vertical hollow portion and a substantially horizontal portion. The one-piece second member is mechanically interconnected and rigidly affixed to the one-piece first member to form a unitary and integral vent apparatus. The substantially horizontal portion of the one-piece second member forms a cap-like structure over the top of the substantially vertical hollow portion of the one-piece first member. The substantially vertical hollow portion of the one-piece second member is disposed substantially concentric with the substantially vertical hollow portion of the one-piece first member to form an annular space between at least a portion of the internal surface of the substantially vertical hollow portion of the second member and the exterior surface of at least such predetermined portion of the substantially vertical hollow portion of the one-piece first member.

The present invention also provides a novel method of fabricating an integral air vent device wherein the cap portion is affixed to the throat portion by metal spinning.

It is an object of the present invention to provide an integral metal air vent apparatus which is fabricated from no more than two pieces.

It is a further object of the present invention to provide a ventilation apparatus which minimizes the amount of exposed horizontal surfaces which in turn minimizes the amount of surface upon which moisture may accumulate and condense.

Yet a futher object of the present invention is to provide a vent apparatus which is more sturdy than the prior art devices, but yet which is easier and less costly to manufacture.

Other objects of the present invention will appear in the following description and appended claims, reference being had to the accompanying drawings which form a part of this specification wherein like reference characters designate corresponding parts in the several views.

DETAILED DESCRIPTION OF THE INVENTION

Before explaining the present invention in detail, it is to be understood that the present invention is not limited in its application to the details of construction and arrangement of parts which are illustrated in the accompanying drawings, because the present invention is capable of other embodiments and of being practiced and carried out in various ways. Furthermore, it is to be understood that the phraseology and terminology employed herein is for the purpose of description and illustration only, and not for the purpose of limitation.

Figure 1:
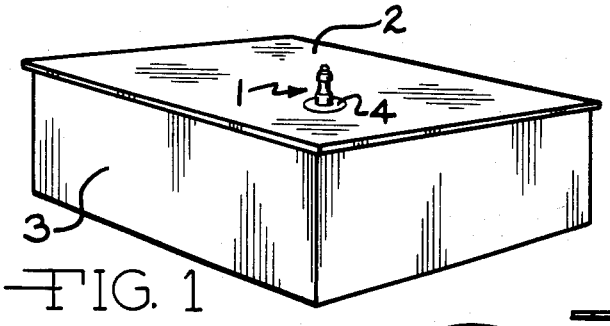
FIG. 1 illustrates an embodiment of the present invention positioned on the flat roof of a building.

Referring to the drawings, and particularly to FIG. 1, there is shown a ventilation apparatus 1 in accordance with the present invention which is secured to the flat roof 2 of a building 3. In FIG. 1 the substantially horizontal, substantially flat, annular portion 4 of the ventilation apparatus 1 is shown exposed or uncovered for purposes of illustration only. In practice, the horizontal annular portion 4 would be covered with a fibergel membrane and asphalt, and possibly other flashy material. In addition, although the apparatus 1 has been shown secured to the flat room 2 of the building 3, it is possible to utilize the ventilation apparatus 1 in connection with buildings which do not possess flat roofs.

Figure 2:
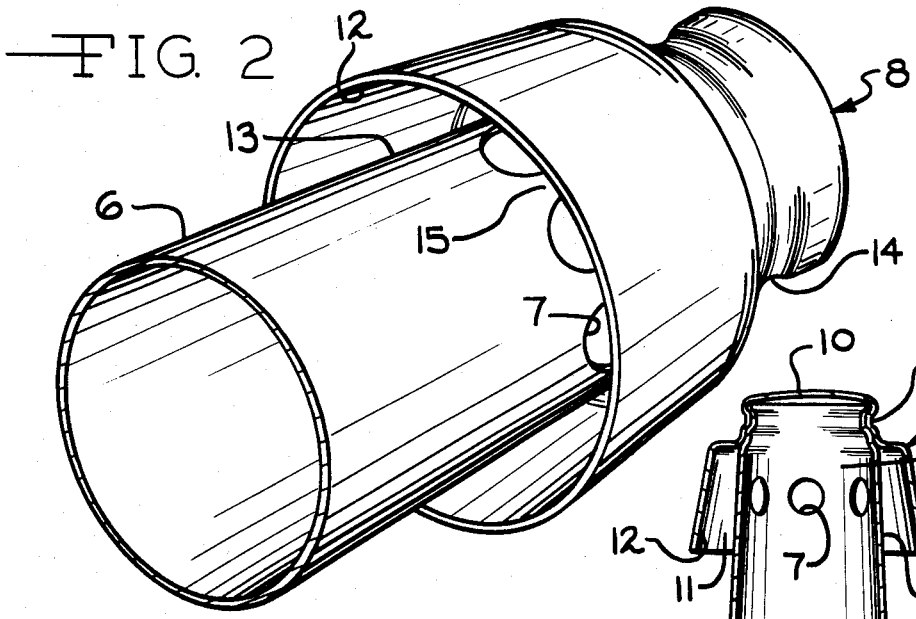
FIG. 2 depicts an enlarged perspective view of the upper portion of the ventilation apparatus in accordance with the present invention.
Figure 3:
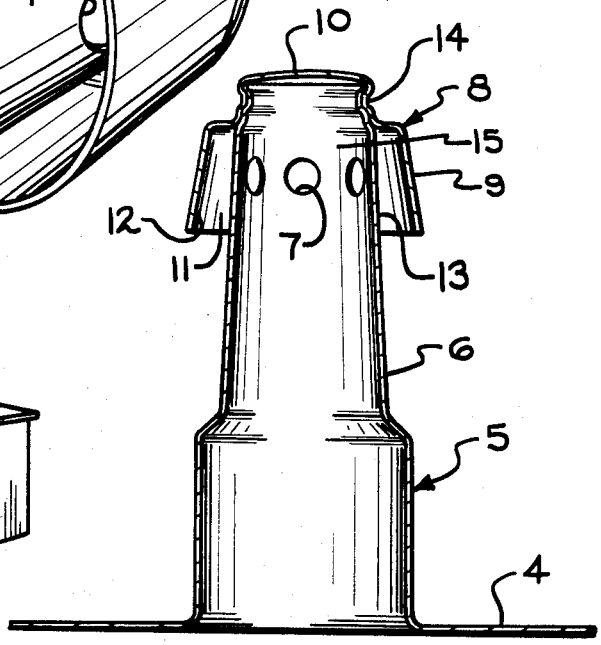
FIG. 3 illustrates a central, vertical elevational section of the full ventilation apparatus in accordance with the present invention, only a portion of which is illustrated in FIG. 2.

With reference to FIGS. 2 and 3, there is shown the ventilation apparatus 1 which includes a one-piece first member 5 which is provided with a substantially vertical hollow portion 6 and the aforementioned substantially horizontal, substantially flat, annular portion 4.

The vertical hollow portion 6 of the first member 5 is provided with at least one ventilation aperture therethrough, such as apertures 7, in a predetermined portion thereof.

The apparatus 1 also includes a one-piece second member 8 which is provided with a substantially vertical hollow sidewall portion 9, a substantially horizontal topwall portion 10 and a circumferentially extending, generally vertical band 14 radially inset from sidewall portion 9 and connecting the sidewall portion 9 with topwall portion 10. The band 14 of the second member 8 is mechanically interconnected and rigidly affixed to the first member 5 to form a unitary and integral vent apparatus 1.

The horizontal portion 10 of the second member 8 forms a cap-like structure over the top of the vertical portion 6 of the first member 5.

It should be further noted that the vertical portion 9 of the second member 8 is disposed substantially concentric with the vertical portion 6 of the first member 5 to form an annular space 11 between at least a portion of the internal surface 12 of the vertical portion 9 of the second member 8 and the exterior surface 13 of at least the aforesaid predetermined portion of the vertical portion 6 of the first member 5.

In accordance with a preferred working and operable embodiment of the present invention, the ventilation apparatus 1 was fabricated from an aluminum Alloy 3003 which was 0.05 inches in thickness. The alluminum alloy was also dipped in caustic acid. A significant feature of the present invention resides in the fact that the members 5 and 8 are securely interconnected to form a unitary and integral structure by means of spinning the cap-like structure 8 onto the first member 5. In this connection, careful attention is directed to the circumferential connecting band 14 which is disposed in overlapping, face-to-face relationship to surface 13, where the spinning process results in conjugally deformed sections which extend radially inward to produce a binding force which secures members 5 and 8 together. The spinning technique of securing together the members 5 and 8 provides a very strong integral structure, and at the same time eliminates the need for any fastening means which may rust and which may become loosened with the passage of time.

Although any desired number of apertures 7 may be provided in the predetermined or throat portion 15 of the apparatus, six such apertures has been found convenient in some preferred embodiments of the present invention.

It should also be noted that air, which may be laden with moisture, that emanates through the apertures 7 from the interior of member 5 will empty into the annular space 11. It is significant that the arrangement of the present invention affords no horizontal surface in the vicinity of the cap-like structure 8 upon which such moisture may condense or accumulate. At the same time, the cap-like structure 8 prevents snow, rain, etc. from going into and through the apertures 7. The vertical portion 9 of the member 8 also shields the apertures 7 from gusts of wind.

Figure 4:
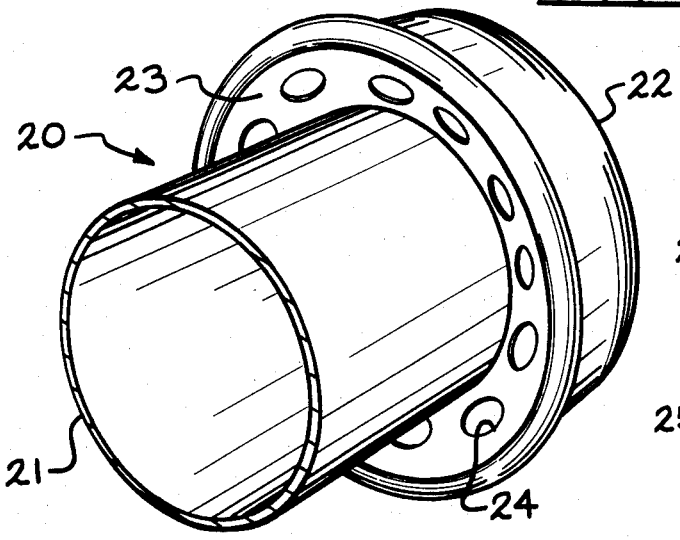
FIG. 4 depicts an enlarged perspective view of a portion of the prior art ventilation apparatus.
Figure 5:
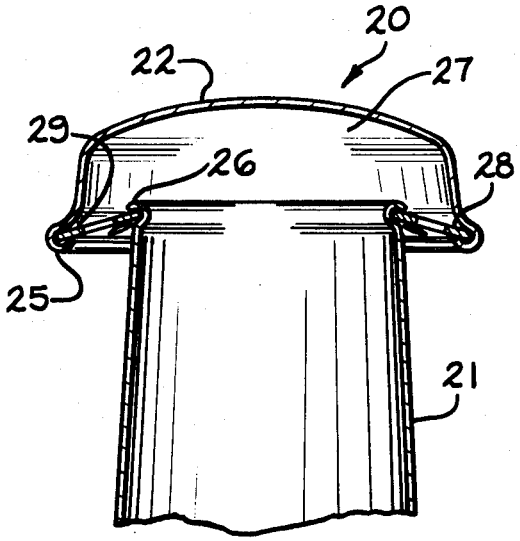
FIG. 5 illustrates a vertical, central, partial elevational view of the prior art apparatus which is shown in FIG. 4.

Attention is now directed to FIGS. 4 and 5 which are two views of the closest prior art device currently in use. FIGS. 4 and 5 show the prior art ventilation apparatus 20 which is fabricated from three members, namely a main member 21, a cap 22, and a conical ring 23. The ring 23 is provided with twelve evenly spaced apertures 24.

As shown in FIG. 5, in fabricating the apparatus 20 it is necessary to form a lip 25 on the cap 22, and a lip 26 at the top of the main member 21. By a somewhat cumbersome and time-consuming manufacturing process, the ring 23 is required to be oriented between the lips 25 and 26 and then secured thereto by crimping the lips 25 and 26 about the edges of the ring 23.

Thus, in the utilization of the prior art device shown in FIGS. 4 and 5 the air emanating from the building comes up through the vertical stack of the main member 21 and moves into a substantially closed chamber 27. The air must enter this chamber 27 before it can pass out through the apertures 24. In contrast, it should be noted that the apparatus according to the present invention provides no such chamber 27.

It is also significant to note that the ring 23 provides a somewhat horizontal surface 28 upon which moisture from such air may condense and accumulate. The aforementioned accumulation is very pronounced in the pockets 29 formed in the area of the lip 25.

Reverting back to FIGS. 2 and 3, the present invention is designed so that the air emanating from the building 3 to which the apparatus 1 is secured may pass through the apertures 7 to the ambient before even reaching the top of the throat 15 or the cap-like structure 8. This feature, in conjunction with the feature of avoiding any horizontal surface upon which moisture can accumulate or condense, gives the present invention a significant advantage over the prior art techniques. This becomes abundantly clear when one considers the problem of accumulation in the device of soot, other particulate material, and other pollutants, which problem is eliminated by the present invention.

It is believed that with the above description and illustrations, the features of the present invention will be apparent to those skilled in this area of technology. For a definition of the scope of the invention, reference should be had to the appended claims.

I claim:

1. A roof ventilation device, comprising:

a tubular member haing a base, a top, an upper portion spaced below said top, and at least one ventilation aperture in said tubular member; and a one-piece cap disposed over said upper portion of said tubular member and covering said aperture, said cap including (1) a circumferentially extending, generally vertical sidewall radially spaced from said tubular member, said sidewall defining an annular space between said sidewall and said upper portion of said tubular member, (2) a topwall covering said top of said tubular member;

(3) a circumferential first band connecting said topwall with said sidewall, said first band being radially inset relative to said sidewalls;

said upper portion having a circumferential second band extending about the circumference of said upper portion, said second band being the compliment of said first band and radially inset relative to said upper portion;

said first band conjugally interconnecting with said second band providing a tight, interference fit connection between said cap and said tubular member, wherein said conjugally interconnected first and second bands of said cap and said upper portion of said tubular member radially overlap each other.

2. The roof ventilation device of claim 1, including a flat, horizontally extending annular portion formed integral with said base and extending radially outwardly from said tubular member.

* * * * *